US009784065B2

(12) United States Patent
Holtby et al.

(10) Patent No.: US 9,784,065 B2
(45) Date of Patent: Oct. 10, 2017

(54) APPARATUS AND METHOD FOR STRIPPING SOLIDS AND FLUIDS FROM A STRING USED IN DRILLING OR SERVICING WELLS

(71) Applicant: Katch Kan Holdings Ltd., Edmonton (CA)

(72) Inventors: Quinn A. J. Holtby, Edmonton (CA); Dallas Greenwood, Edmonton (CA)

(73) Assignee: Katch Kan Holdings Ltd., Edmonton (CA)

( * ) Notice: Subject to any disclaimer, the term of this patent is extended or adjusted under 35 U.S.C. 154(b) by 207 days.

(21) Appl. No.: 14/601,930

(22) Filed: Jan. 21, 2015

(65) Prior Publication Data

US 2015/0211320 A1 Jul. 30, 2015

Related U.S. Application Data

(60) Provisional application No. 61/931,794, filed on Jan. 27, 2014.

(51) Int. Cl.

| | |
|---|---|
| ***E21B 33/08*** | (2006.01) |
| ***E21B 33/00*** | (2006.01) |
| ***E21B 19/08*** | (2006.01) |
| ***E21B 17/00*** | (2006.01) |

(52) U.S. Cl.

CPC ..... *E21B 33/08* (2013.01); *E21B 17/006* (2013.01); *E21B 19/08* (2013.01); *E21B 33/00* (2013.01)

(58) Field of Classification Search

CPC ..... E21B 17/006; E21B 33/08; E21B 19/08; E21B 33/00; E21B 33/02

See application file for complete search history.

(56) References Cited

U.S. PATENT DOCUMENTS

| | | | | |
|---|---|---|---|---|
| 693,046 A * | 2/1902 | Miller | E21B 33/08 277/506 |
| 1,369,913 A | 3/1921 | Brunhoff | |
| 1,632,889 A | 6/1927 | Davis | |
| 1,639,209 A | 8/1927 | Bell | |
| 1,868,794 A | 7/1932 | Fuller et al. | |
| 1,910,045 A | 5/1933 | Paryzek | |
| 2,068,665 A | 1/1937 | Douglas | |
| 2,096,882 A * | 10/1937 | Chernosky | E21B 33/08 15/220.4 |
| 2,126,671 A | 8/1938 | Slaugenhop | |

(Continued)

FOREIGN PATENT DOCUMENTS

| | | |
|---|---|---|
| CA | 1 178 196 A | 11/1984 |
| CA | 2 341 996 A1 | 9/2002 |

(Continued)

OTHER PUBLICATIONS

Control Drilling Services, "Control Automatic Pipe Wiper," retrieved from http://www.controldrillingservice.com/stripomatic.shtml on Aug. 22, 2013, 3 pages.

(Continued)

*Primary Examiner* — Yong-Suk (Philip) Ro

(74) *Attorney, Agent, or Firm* — Seed IP Law Group LLP

(57) ABSTRACT

Three or more overlapping sealing members arranged circumferentially around a passage in a supporting body form an annular seal around a pipe inserted into the passage.

9 Claims, 5 Drawing Sheets

(56) References Cited

U.S. PATENT DOCUMENTS

| | | | | | |
|---|---|---|---|---|---|
| 2,214,428 | A | * | 9/1940 | Miller | E21B 21/01 166/81.1 |
| 2,328,127 | A | | 8/1943 | Crickmer | |
| 2,353,412 | A | * | 7/1944 | Miller | E21B 33/08 166/81.1 |
| 2,392,146 | A | | 1/1946 | Hall | |
| 2,444,653 | A | | 7/1948 | Kennedy et al. | |
| 2,505,282 | A | | 4/1950 | Endsley | |
| 2,510,114 | A | | 6/1950 | Hummel | |
| 2,514,817 | A | | 7/1950 | Wheaton et al. | |
| 2,550,487 | A | | 4/1951 | MacClatchie | |
| 2,559,782 | A | | 7/1951 | Meek | |
| 2,568,247 | A | | 9/1951 | Medearis | |
| 2,609,836 | A | | 9/1952 | Knox | |
| 2,611,146 | A | | 9/1952 | Buckley | |
| 2,655,679 | A | | 10/1953 | Grant | |
| 2,706,648 | A | | 4/1955 | Gosse | |
| 2,715,235 | A | | 8/1955 | Dawson | |
| 2,746,781 | A | | 5/1956 | Jones | |
| 2,809,012 | A | | 10/1957 | Stevens | |
| 2,850,754 | A | * | 9/1958 | Davis | E21B 33/08 15/104.04 |
| 2,880,440 | A | | 4/1959 | Shipley | |
| 2,914,786 | A | | 12/1959 | Hunt | |
| 2,936,031 | A | | 5/1960 | Seago | |
| 3,029,083 | A | | 4/1962 | Wilde | |
| 3,055,036 | A | | 9/1962 | Minor | |
| 3,173,502 | A | | 3/1965 | Overby | |
| 3,322,198 | A | * | 5/1967 | McHenry | E21B 21/01 166/81.1 |
| 3,329,987 | A | | 7/1967 | Grant | |
| 3,353,606 | A | | 11/1967 | Dyer | |
| 3,392,416 | A | | 7/1968 | Grant | |
| 3,412,804 | A | | 11/1968 | Turbyfill | |
| 3,422,483 | A | | 1/1969 | Craycraft | |
| 3,466,693 | A | | 9/1969 | Grant | |
| 3,559,739 | A | | 2/1971 | Hutchison | |
| 3,564,671 | A | | 2/1971 | Straus | |
| 3,667,721 | A | | 6/1972 | Vujasinovic | |
| 3,733,641 | A | | 5/1973 | Brown | |
| 3,822,753 | A | | 7/1974 | Tate | |
| 3,833,753 | A | | 9/1974 | Garboushian | |
| 3,902,215 | A | | 9/1975 | Waldrop et al. | |
| 3,921,991 | A | | 11/1975 | Beck | |
| 3,958,808 | A | * | 5/1976 | Lewis | E21B 33/06 251/1.2 |
| 4,010,633 | A | | 3/1977 | Hasha | |
| 4,123,095 | A | | 10/1978 | Stehlin | |
| 4,358,085 | A | | 11/1982 | Regan et al. | |
| 4,406,331 | A | | 9/1983 | Bentley | |
| 4,450,905 | A | * | 5/1984 | Crain | E21B 21/01 166/81.1 |
| 4,457,366 | A | | 7/1984 | Brown | |
| 4,480,703 | A | | 11/1984 | Garrett | |
| 4,494,607 | A | | 1/1985 | Ford et al. | |
| 4,658,894 | A | | 4/1987 | Craig | |
| 4,690,213 | A | | 9/1987 | Stannard et al. | |
| 4,895,205 | A | | 1/1990 | Thompson et al. | |
| 4,982,787 | A | | 1/1991 | Reddoch | |
| 5,062,479 | A | | 11/1991 | Bailey et al. | |
| 5,101,896 | A | | 4/1992 | Thompson et al. | |
| 5,217,069 | A | | 6/1993 | Badon | |
| 5,295,278 | A | | 3/1994 | Condon et al. | |
| 5,323,854 | A | | 6/1994 | Pursley, Jr. | |
| 5,836,386 | A | | 11/1998 | Haggard | |
| 5,842,252 | A | | 12/1998 | Cameron et al. | |
| 5,901,964 | A | | 5/1999 | Williams et al. | |
| 5,992,277 | A | * | 11/1999 | Dalseide | B08B 9/023 15/93.1 |
| 6,031,862 | A | | 2/2000 | Fullerton et al. | |
| 6,119,772 | A | | 9/2000 | Pruet | |
| 6,155,358 | A | | 12/2000 | Brown | |
| 6,591,916 | B1 | | 7/2003 | Ayling | |
| 6,749,172 | B2 | | 6/2004 | Kinder | |
| 6,769,491 | B2 | | 8/2004 | Zimmerman et al. | |
| 7,125,056 | B2 | | 10/2006 | Saarem | |
| 7,240,727 | B2 | | 7/2007 | Williams | |
| 7,306,032 | B2 | | 12/2007 | Paton | |
| 7,380,610 | B2 | * | 6/2008 | Williams | E21B 33/085 166/387 |
| 7,392,860 | B2 | | 7/2008 | Johnston | |
| 7,409,988 | B2 | | 8/2008 | Borden et al. | |
| 7,413,194 | B2 | | 8/2008 | Wright et al. | |
| 7,416,021 | B2 | * | 8/2008 | Williams | E21B 33/085 166/387 |
| 7,621,344 | B2 | | 11/2009 | Frey | |
| 7,654,313 | B2 | | 2/2010 | Angman | |
| 8,251,151 | B2 | | 8/2012 | Haugen | |
| 2002/0179300 | A1 | | 12/2002 | Gay et al. | |
| 2007/0240874 | A1 | * | 10/2007 | Williams | E21B 33/085 166/84.3 |
| 2007/0295516 | A1 | * | 12/2007 | Williams | E21B 33/085 166/387 |
| 2009/0014182 | A1 | | 1/2009 | Frey | |
| 2010/0200219 | A1 | | 8/2010 | Reddoch, Sr. | |
| 2011/0108278 | A1 | | 5/2011 | Holtby | |
| 2012/0006554 | A1 | | 1/2012 | Allen et al. | |

FOREIGN PATENT DOCUMENTS

| | | | |
|---|---|---|---|
| CA | 2 512 540 | A1 | 1/2007 |
| CA | 2 702 567 | A1 | 10/2010 |
| GB | 958729 | A | 5/1964 |
| GB | 1097323 | A | 1/1968 |

OTHER PUBLICATIONS

CPI Packings, "Mechanical packing: design and theory of operation," product brochure, reprint of the original write-up in 1968 by Ed Cummings, 16 pages.

Katch Kan, "Rig Safety System™ (RSS™)," Product Data Sheet, 2015, 2 pages.

Katch Kan, "Window Stripper™," Product Data Sheet, 2015, 1 page.

* cited by examiner

APPARATUS AND METHOD FOR STRIPPING SOLIDS AND FLUIDS FROM A STRING USED IN DRILLING OR SERVICING WELLS

CROSS-REFERENCE TO RELATED APPLICATIONS

This application claims the benefit under 35 USC 119(e) of U.S. provisional application Ser. No. 61/931,794 filed Jan. 27, 2014.

TECHNICAL FIELD

The present disclosure is related to the field of apparatuses, in particular, hand held pipe wipers and seals for wiping fluids and solids off pipe sections of a string used in the drilling of a well, or in the servicing of a well, as the pipe sections are removed from the well, and methods of using same.

BACKGROUND

As sections of pipe in a string used either on a drilling rig in the drilling of wells or on a service rig in the servicing of wells are removed from or "tripped out" of the well, they are often covered with solids and/or fluids. Before the pipe sections are put back into a storage rack or facility, it is desirable that the solids or fluids be removed or stripped off of the pipe. Known methods for removing solids or fluids from pipe sections being tripped out of a well are cumbersome and can be difficult, if not dangerous, for drilling personnel to use.

Known methods for removing solids or fluids from pipe sections being tripped out of a well include the manual use of rags and gunny sacks which require the hands of drilling personnel to be in close proximity to the drilling fluid. The drilling fluid is often at high temperatures and can burn the hands of drilling personnel. The known methods can result in the wiping device being dropped down into the drill hole.

It is, therefore, desirable to provide a pipe wiper and seal that can wipe or strip off solids from pipe sections being tripped out of a well that is easy to handle by personnel on the well.

SUMMARY

An apparatus and method for stripping solids and fluids from sections of pipe on a string used in the drilling of wells or used in the servicing of wells is disclosed. For purposes of this specification and the claims contained herein, the term "string" is defined to include a drill string comprised of multiple sections of drill pipe joined together and used on a drilling rig for the drilling of wells, a string of pipe comprised of multiple sections of pipe joined together and used on a service rig for the servicing of wells, and coil tubing that is used in the directional drilling of wells in addition to the servicing of wells. For purposes of this specification and the claims contained herein, the term "rig" is defined to include both well drilling rigs and well servicing rigs as well as snubbing units, push/pull rigs, coil tubing units, and other mechanical devices used to insert or remove string from a well.

In one embodiment, an apparatus is provided comprising a hand held pipe wiper. The pipe wiper can be used primarily to strip off solids and fluids from a string when it is being removed from a well. The pipe wiper can be provided with handles so it can be used manually by drilling personnel.

In one embodiment, the pipe wiper can comprise two or more portions that are hinged together so that the pipe wiper can be opened and placed around a string and then closed around the string to form a generally cylindrical body that encloses the string in a clamshell fashion. The pipe wiper can further comprise a releasable latch mechanism that can hold the pipe wiper body portions together. In this manner, the pipe wiper can easily and quickly be connected when installed on a string, and then easily and quickly disconnected and removed from the string when the string has been stripped of solids and fluids.

In another embodiment, the pipe wiper can further comprise a flexible toroidal seal disposed in the pipe wiper body. The seal can have multiple parts, one part for each portion of the hinged body. When the pipe wiper is enclosed around a string, the seal can form a toroidal sealing member having a central opening that can fit tightly around the string. In another embodiment, the seal can be configured to flex and stretch such that the central opening can expand in diameter so that the seal can pass over a connection between sections of pipe as the string is being raised out of a well, and then contract in diameter to the pipe's diameter after the pipe connection has passed through the pipe wiper. In operation, the pipe wiper can be placed and enclosed around a string and can be held in position by drilling personnel on the rig floor by gripping the handles to ensure stabilization of the pipe wiper as the string is being raised out of the well. As the string is raised, it passes through the pipe wiper and the sealing member in the pipe wiper strips off solids and fluids from the exterior surface of the string, the solids and fluids falling onto the rig floor.

In a further embodiment, the seal can be removably installed in the pipe wiper so as to provide a variety of seals having differently sized openings to accommodate strings of different diameters, or to be able to easily replace a damaged seal in the pipe wiper.

"Handle" as used herein can include anything know in the art or yet to be developed which will allow a worker to grip the apparatus. The handle can be integrally formed into the body of the apparatus or can be attached separately. The handle can allow for increasing the distance between the hands of drilling personnel and the drilling fluid.

Broadly stated, a hand held pipe wiper is provided for stripping off solids and fluids from a string in the drilling or servicing of a well, comprising: two or more arcuate body portions pivotally connected together and configured to form a cylindrical body when enclosed around the string; a latch mechanism disposed on one or more body portions, the latch mechanism configured to releasably connect the arcuate body portions together to form the cylindrical body; one or more handles disposed on the arcuate body portions; and a sealing member disposed in the cylindrical body, the sealing member configured to form a toroidal seal around the string when the cylindrical body is enclosed around the string whereby the sealing member strips solids and fluids off of the string when the string passes through the pipe wiper.

A seal is provided for placement within a supporting body, the supporting body defining a generally cylindrical passage for receiving a pipe, the seal comprising three or more sealing members arranged circumferentially around the generally cylindrical passage and circumferentially overlapping within the supporting body, the three or more sealing members defining an opening to receive the pipe, the opening being aligned with the generally cylindrical passage, the three or more sealing members forming an annular seal around the pipe when the pipe is in the opening. The sealing members may form a conical shape when unstressed. The sealing members may taper in thickness in an inward radial direction. The supporting body may comprise two or more arcuate body portions pivotally connected together to define and enclose the generally cylindrical passage when closed together. The supporting body may further comprise one or more handles disposed on the arcuate body portions. The supporting body may comprise a groove disposed on an interior surface of the body for receiving the sealing members.

Broadly stated, a method is provided for stripping off solids and fluids from a string being removed from a well, the method comprising the steps of: providing a hand held pipe wiper, comprising: two or more arcuate body portions pivotally connected together and configured to form a cylindrical body when enclosed around the string, a latch mechanism disposed on one or more body portions, the latch mechanism configured to releasably connect the arcuate body portions together to form the cylindrical body, one or more handles disposed on the arcuate body portions, and a sealing member disposed in the cylindrical body, the sealing member configured to form a toroidal seal around the string when the cylindrical body is enclosed around the string whereby the sealing member strips solids and fluids off of the string when the string passes through the pipe wiper; enclosing the pipe wiper around the string whereby the sealing member has formed the toroidal seal around the string; and holding the pipe wiper in position while the string is being raised out of the well whereby the sealing element strips off solids and fluids from the string.

DETAILED DESCRIPTION OF EMBODIMENTS

Figure 1:
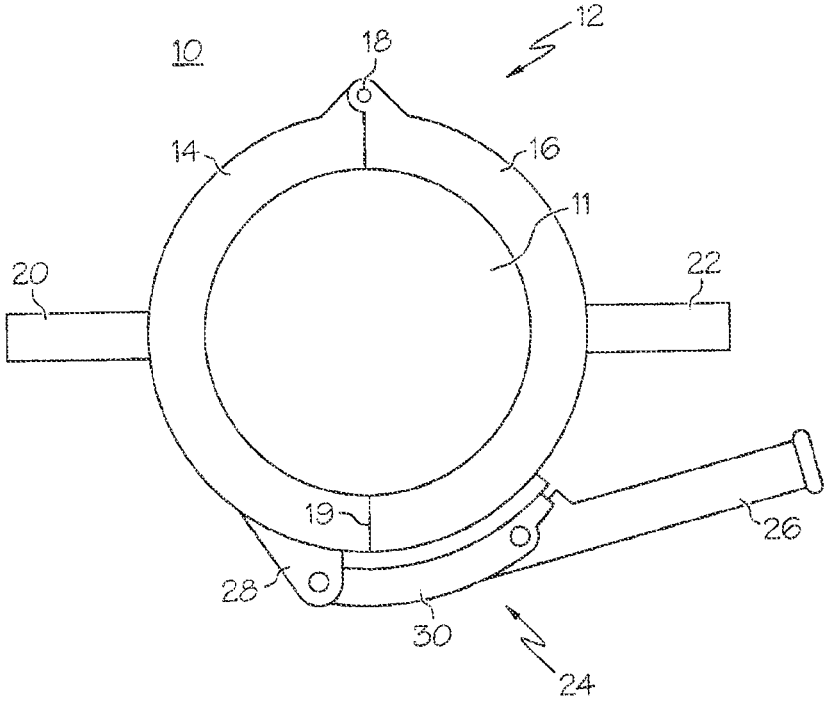
FIG. 1 is a top plan view depicting a pipe wiper.
Figure 2:
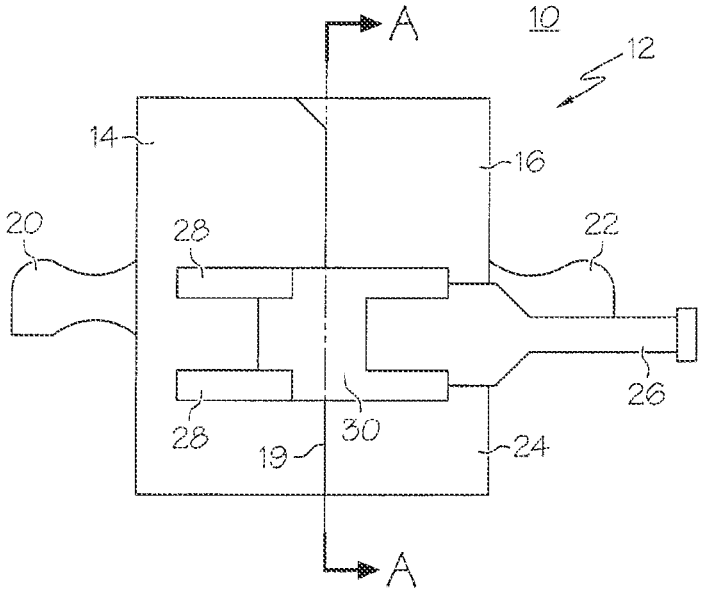
FIG. 2 is a side elevation view depicting the pipe wiper of FIG. 1.

Referring to FIGS. 1 and 2, an embodiment of pipe wiper 10 is shown. In this embodiment, pipe wiper 10 can comprise body 12 consisting of arcuate or semicircular body halves 14 and 16 that are pivotally connected together with hinge 18. When body halves 14 and 16 are closed together to meet at seam 19, body 12 defines interior 11 through which a string can be placed and pass through. While this embodiment comprises two semi-circular body halves 14 and 16 to form cylindrical or tubular body 12, it should be understood that three or more arcuate body portions pivotally connected together can be used to form body 12. In other embodiments of pipe wiper 10, body 12 can have a cross-sectional shape that is not circular, such shapes including: triangular, square, rectangular, oval and polygonal cross-sectional shapes. For the purposes of this specification and the claims contained herein, the terms "arcuate", "semi-circular", "cylindrical", "tubular" and any other like terms are hereby defined to include both circular and non-circular cross-sectional shapes of body 12 and parts therefor, including a sealing member that is disposed in body 12 and discussed in further detail below.

Body 12 can further comprise handle 20 disposed on body half 14 and handle 22 disclosed on body half 16 so as to enable a person to grasp and hold onto pipe wiper 10 when a string is raised through it. Pipe wiper 10 can further comprise latch mechanism 24 to hold body halves 14 and 16 together when pipe wiper 10 is being used. In the illustrated embodiment, latch mechanism 24 can comprise fixed hinge member 28 disposed on body half 14 that can be pivotally connected to movable latch member 30, which, in turn, can be pivotally connected to handle 26. Handle 26 can be further configured to engage a keeper or stay member disposed on body half 16 (not shown) to hold body halves 14 and 16 together when handle 26 is rotated towards body 12 whereby latch mechanism 24 can operate as an "over center latch." To open pipe wiper 10, handle 26 can be pulled and rotated away from body half 16 to disengage the keeper disposed thereon whereby handle 26 and latch member 30 can be rotated further away from body half 16 so as to enable the removal of pipe wiper 10 from a pipe section. It should be apparent that any suitable latching mechanism can be used in substitution of the illustrated latch mechanism 24 to couple body halves 14 and 16 together.

Figure 3:
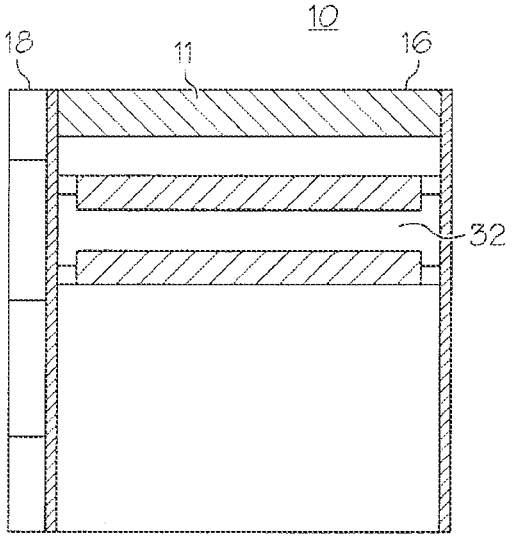
FIG. 3 is a side cross-section view depicting the pipe wiper of FIG. 2 along section lines A-A.

Referring to FIG. 3, a cross-sectional view of pipe wiper 10 is shown, namely, the interior view of body half 16. As shown in this embodiment, the interior surface of body half 16 can comprise groove 32 disposed thereon where a sealing element can be removably placed. A corresponding groove 32 can also be disposed on the interior surface of body half 14 (not shown). Groove 32 enables the easy installation and removal of sealing elements in body halves 14 and 16 so that the sealing element can be replaced when it becomes damaged or when a sealing element for a different diameter pipe is required.

Figure 4:
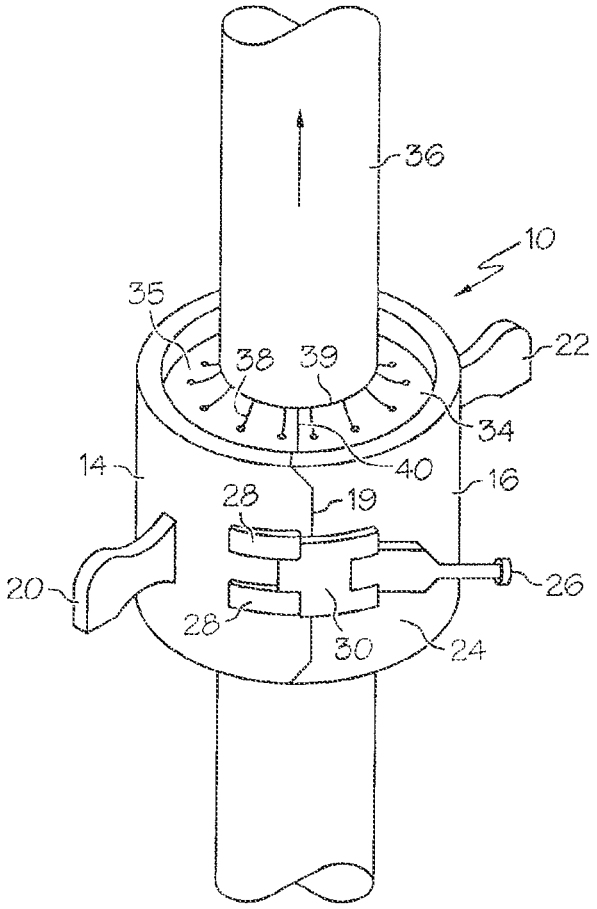
FIG. 4 is a perspective view depicting the pipe wiper of FIG. 1 installed on a string being raised.

Referring to FIG. 4, pipe wiper 10 is shown installed on pipe 36 as it is being raised through pipe wiper 10. In this embodiment, pipe wiper 10 is shown comprised of semi-circular body halves 14 and 16 each having arcuate seal members 34 and 35 disposed therein, respectively. When pipe wiper 10 is installed around pipe 36, as shown, seal members 34 and 35 meet at seam 40 to form opening 39 that, in turn, forms a toroidal seal around pipe 36. Seal members 34 and 35 can be configured to be removably placed or installed in grooves 32 disposed in body halves 14 and 16. Seal members 34 and 35 can be made of any suitable elastomeric material that enables seal members 34 and 35 to flex and stretch so as to maintain contact with the external surface of pipe 36 due to any irregularities to the cross-sectional shape of pipe 36 or to the contour of the pipe's external surface and, in addition, to allow opening 39 to expand in diameter so as to enable any joint connection between two sections of pipe to pass through seal members 34 and 35 as a joint connection can have a larger diameter than the diameter of the pipe itself. Suitable examples of the elastomeric material for seal members 34 and 35 can include natural rubber, neoprene rubber, foam rubber, silicone based rubber, nitrile rubber and any other material that is suitable for use as a seal that can be used to strip petroleum-based substances from a string. The elastomeric material for seal members 34 and 35 can also be a low weight material which would allow seal members 34 and 35 to float on the drilling fluid if seal members 34 and 35 were dropped into well.

In another embodiment, seal members 34 and 35 can further comprise means for allowing opening 39 to expand and contract in diameter. In one embodiment, the means can comprise a plurality of relief cuts 38 disposed thereon to allow opening 39 to expand in diameter when a joint connection between two pipe sections are passed through pipe wiper 10, and to contract in diameter when the joint connection has passed through pipe wiper 10. In the illustrated embodiment, relief cuts 38 are shown as straight cuts in a radial configuration extending outwardly from opening 39. The relief cuts 38 can be of any other suitable configuration on seal members 34 and 35 so as to allow opening 39 to expand and contract in diameter as a pipe joint connection passes through seal members 34 and 35.

In a representative embodiment, body 12, handles 20 and 22, and latch mechanism 24 can be made of a polymer plastic material so as to minimize the weight of pipe wiper 10 and still maintain the necessary structural strength required for a tool of this nature. However, it should be understood that other materials can be used in the construction in pipe wiper 10, such as metal, metal alloys or any other suitable construction material.

Figure 5:
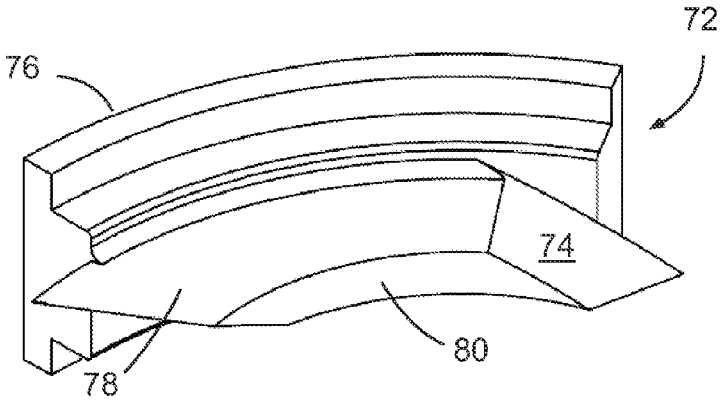
FIG. 5 is a perspective view showing a seal portion.
Figure 6:
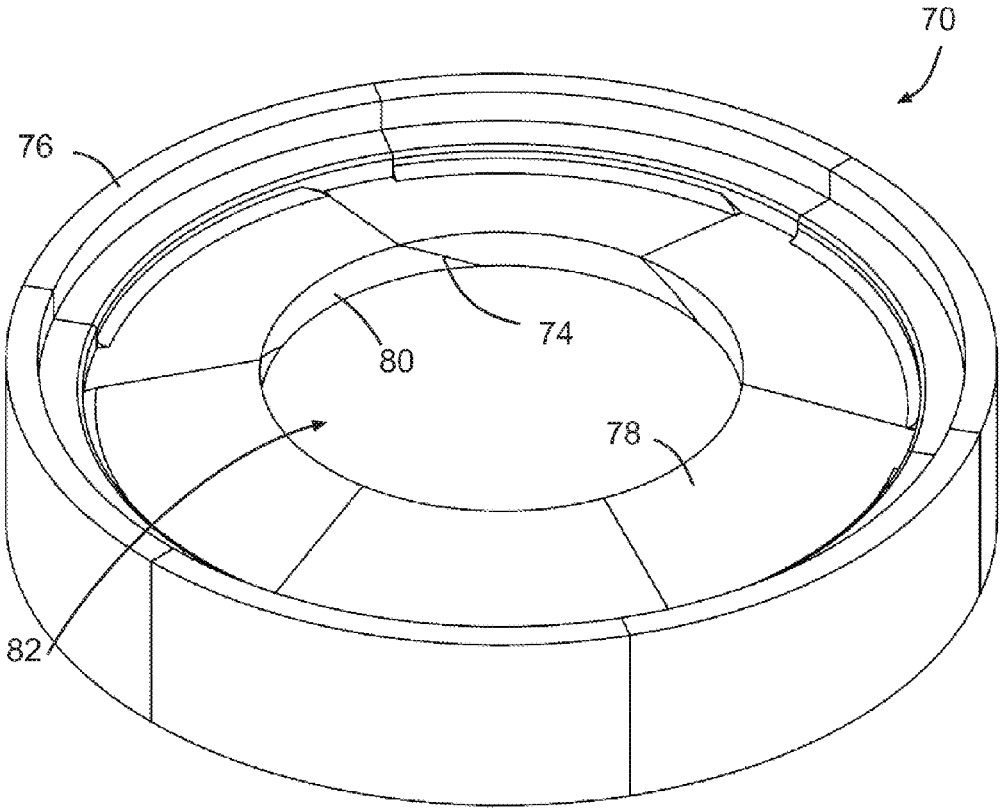
FIG. 6 is a perspective view showing a seal insert comprising six seal portions as in FIG. 5.
Figure 7:
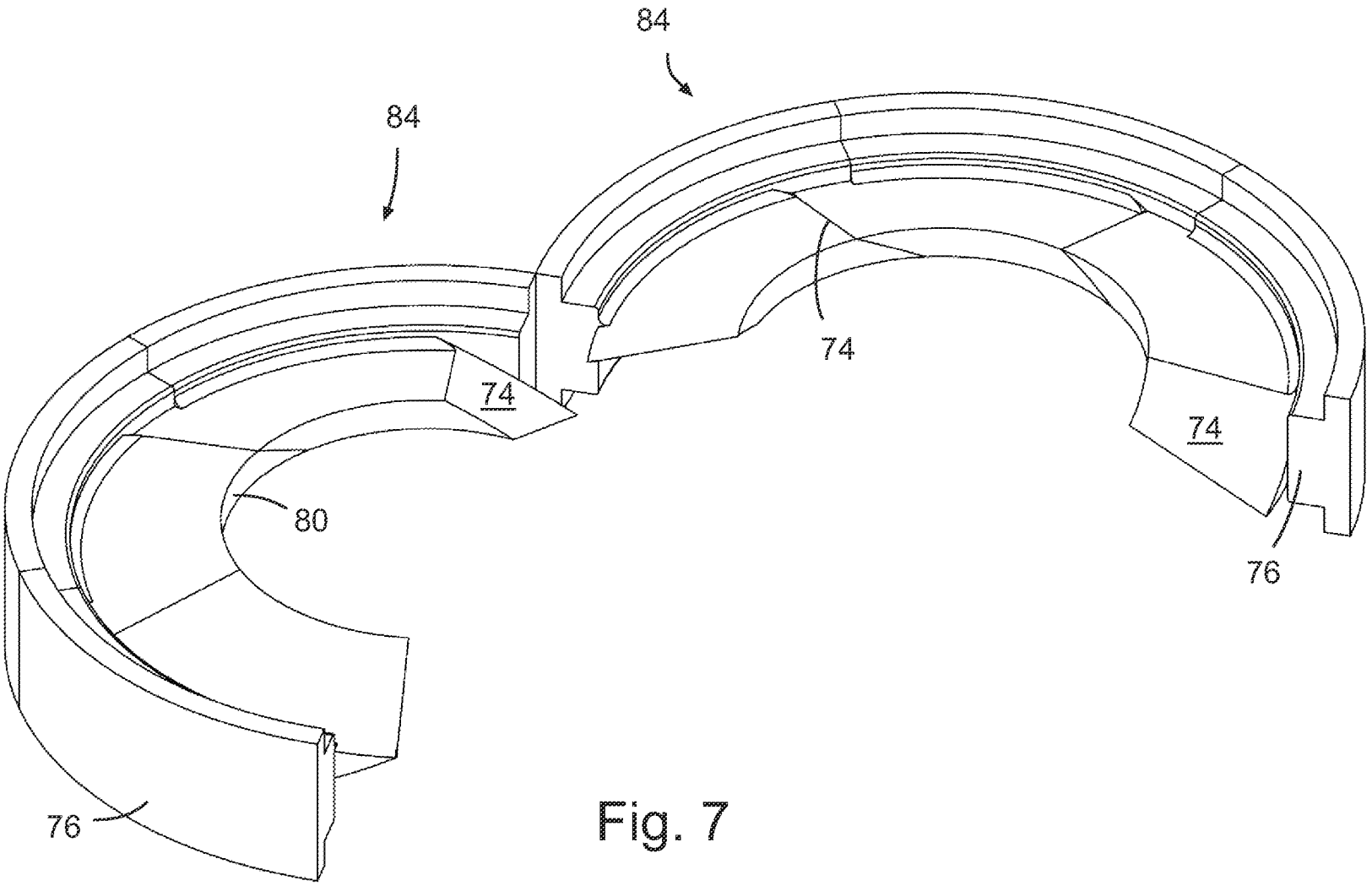
FIG. 7 is a perspective view showing the seal insert of FIG. 6 split into two halves each having three seal portions, as might for example each be associated with a respective body portion of a pipe wiper.

Referring now to FIGS. 5-7, a further embodiment of a seal for use with pipe wiper 10 is shown as seal insert 70. The seal insert is placed within pipe wiper 10 which acts as a supporting body. Seal insert 70 is comprised of multiple portions 72 arranged circumferentially around interior 11 of pipe wiper 10 to define an opening 82 to receive a pipe for cleaning the pipe, and are separated by cuts 74. The seal insert 70 may be made of an elastomeric material, which along with the cuts 74 allows the seal insert to flex to accommodate different pipe sizes or a joint connection while cleaning the pipe. In the embodiment shown the seal insert 70 comprises six portions 72. Each portion comprises a rim portion 76 and an inner portion 78. In the embodiment shown in an unstressed state the inner portions 78 slant upwards from the rim portions to inner sealing edges 80, forming a conical shape. The conical shape allows the seal insert to more easily flex to accommodate joints or other changes in size of the pipe as the pipe passes upwards through the seal insert. The portions shown are separated by generally radial cuts 74, the portion of the cuts corresponding to the inner portions 78 each having a circumferential slant in the axial direction so that the portions 72 overlap circumferentially, that is, the circumferential ends of each portion pass axially over or under the corresponding circumferential ends of the neighbouring portions. When a larger pipe or larger portion of a pipe passes through the seal insert, the seal insert may expand by circumferential sliding contact along the slanted cuts, preferably maintaining sealing contact across the cuts and with the pipe while in the expanded configuration. Further, sealing contact may preferably be maintained while the portions are undergoing circumferential sliding contact along the slanted cuts. The inner portions 78 also taper from a thicker cross section adjacent to the rim portions to a thinner cross section at inner sealing edges 80. The tapering allows greater flexibility at the sealing edges. The rim portions 76 may be sized and shaped to fit into groove 32 of pipe wiper 10. FIG. 5 shows a single portion 72, FIG. 6 shows a seal insert comprising six portions positioned together to from an opening 82 to receive a pipe for cleaning the pipe. The inner sealing edges 80 form an annular seal around the pipe in use when the pipe is in opening 82. FIG. 7 shows the seal insert of FIG. 6 separated in two halves 84 each comprising three portions 72. Each half 82 may be positioned in a respective body half 14 of pipe wiper 10. Although six portions 72 are shown, a larger or smaller number of portions 72 may be used. In some embodiments there are three or more portions 72. Fewer portions increase the amount of expansion that must be accommodated by each cut to allow a given amount of expansion of the seal insert.

Although a few embodiments have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the scope of the invention is defined and limited only by the claims that follow.

The embodiments of the invention in which an exclusive property or privilege is claimed are defined as follows:

1. A seal for placement within a supporting body, the supporting body defining a generally cylindrical passage for receiving a pipe, the seal comprising:

three or more sealing members arranged circumferentially around the generally cylindrical passage and circumferentially overlapping within the supporting body, the three or more sealing members defining an opening to receive the pipe, the opening being aligned with the generally cylindrical passage, the three or more sealing members forming an annular seal around the pipe when the pipe is in the opening, in which the sealing members form a conical shape when unstressed, and are formed of an elastomeric material that flexes on passage of a tool joint or pipe through the supporting body, and the supporting body is disposed around a well string with the conical shape narrowing upward.

2. The seal of claim 1 in which the sealing members taper to narrow in cross-sectional thickness in an inward radial direction.

3. The seal of claim 1 in which the supporting body comprises two or more arcuate body portions pivotally connected together to define and enclose the generally cylindrical passage when closed together.

4. The seal of claim 3 in which the supporting body further comprises one or more handles disposed on the arcuate body portions.

5. The seal of claim 1 in which the supporting body comprises a groove disposed on an interior surface of the body for receiving the sealing members.

6. The seal of claim 1 in which the seal members are configured to accommodate an expansion of the pipe by moving to an expanded position by circumferential sliding contact of the seal members.

7. The seal of claim 6 in which the circumferential sliding contact is along circumferentially slanted cuts between the seal members.

8. The seal of claim 6 in which seal members maintain a seal between the sealing members while in the expanded position.

9. The seal of claim 8 in which the seal members maintain the seal during the circumferentially sliding contact.

* * * * *